US007649507B2

(12) United States Patent
Joo

(10) Patent No.: US 7,649,507 B2
(45) Date of Patent: Jan. 19, 2010

(54) PLASMA DISPLAY PANEL DEVICE, WHITE LINEARITY CONTROL DEVICE AND CONTROL METHOD THEREOF

(75) Inventor: Mi-Young Joo, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 849 days.

(21) Appl. No.: 10/961,183

(22) Filed: Oct. 12, 2004

(65) Prior Publication Data

US 2005/0083265 A1 Apr. 21, 2005

(30) Foreign Application Priority Data

Oct. 16, 2003 (KR) ..... 10-2003-0072359

(51) Int. Cl.
*G09G 3/28* (2006.01)

(52) U.S. Cl. ..... 345/60; 345/63; 345/72; 345/211

(58) Field of Classification Search ..... 345/60–72, 345/690, 211; 313/484, 582–587, 163
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 7,095,888 | B2 * | 8/2006 | Kim | 345/63 |

(Continued)

FOREIGN PATENT DOCUMENTS

CN 1409285 4/2003

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Sumati Lefkowitz
*Assistant Examiner*—Seokyun Moon
(74) *Attorney, Agent, or Firm*—Robert E. Bushnell, Esq.

(57) ABSTRACT

A plasma display panel, a white linearity control device and a control method thereof. The white linearity control method includes calculating a load ratio of an image signal, determining an automatic power control level corresponding to the load ratio, and calculating first correction data corresponding to the automatic power control level. In addition, the method includes discriminating vertical and horizontal positions of the image signal, and obtaining a white linearity value for a corresponding region from two white linearity values defining a period in which the discriminated positions are included through interpolation, and producing second correction data by multiplying the first correction data by the obtained white linearity value.

8 Claims, 5 Drawing Sheets

U.S. PATENT DOCUMENTS

| | | | | |
|---|---|---|---|---|
| 7,289,086 | B2 * | 10/2007 | Lee | 345/60 |
| 2003/0052841 | A1 | 3/2003 | Tanaka | |
| 2003/0058194 | A1 | 3/2003 | Kang | |

FOREIGN PATENT DOCUMENTS

| | | | |
|---|---|---|---|
| EP | 1 347 434 | | 9/2003 |
| JP | 02-148645 | | 6/1990 |
| JP | 2845183 | | 10/1998 |
| JP | 2917279 | | 4/1999 |
| JP | 2000152035 | | 5/2000 |
| JP | 2001-043804 | | 2/2001 |
| JP | 2001-325888 | | 11/2001 |
| KR | 1998-0010982 | * | 4/1998 |
| KR | 2003-0017222 | * | 3/2003 |

* cited by examiner

FIG.6

Target
x=300, y=300

| | | |
|---|---|---|
| x=305, y=295<br>=> R00, G00, B00 | x=290, y=305<br>=> R01, G01, B01 | x=300, y=305<br>=> R02, G02, B02 |
| x=305, y=300<br>=> R10, G10, B10 | X=300, y=300<br>=> R11=1<br>G11=1<br>B11=1 | x=305, y=310<br>=> R12,G12, B12 |
| x=300, y=295<br>=> R20, G20, B20 | x=295, y=305<br>=> R21, G21, B21 | x=300, y=305<br>=> R22, G22, B22 |

PLASMA DISPLAY PANEL DEVICE, WHITE LINEARITY CONTROL DEVICE AND CONTROL METHOD THEREOF

CLAIM OF PRIORITY

This application makes reference to, incorporates the same herein, and claims all benefits accruing under 35 U.S.C. §119 from an application for PLASMA DISPLAY PANEL DEVICE, WHITE LINEARITY CONTROL DEVICE AND CONTROL METHOD THEREOF earlier filed in the Korean Intellectual Property Office on Oct. 16, 2003 and there duly assigned Serial No. 10-2003-0072359.

BACKGROUND OF THE INVENTION

1. Field of the Invention

The present invention relates to a plasma display panel (PDP) device, and more particularly to a plasma display panel device, a white linearity control device and a control method thereof, which are capable of suppressing variation of white linearity caused by uniformity of the PDP.

2. Description of the Related Art

Plasma display panels (PDPs) are flat panel displays that use plasma generated by gas discharge to display characters or images. The PDPs include, according to their size, more than several tens to millions of pixels arranged in the form of a matrix. These PDPs are classified into a direct current (DC) type and an alternating current (AC) type according to patterns of waveforms of driving voltages applied thereto and discharge cell structures thereof.

The DC PDP has electrodes exposed to a discharge space, thereby causing current to directly flow through the discharge space during application of a voltage to the DC PDP. In this connection, the DC PDP has a disadvantage in that it requires a resistor for limiting the current. On the other hand, the AC PDP has electrodes covered with a dielectric layer that naturally forms a capacitance component to limit the current and protects the electrodes from the impact of ions during discharge. As a result, the AC PDP is superior over the DC PDP in regard to a long lifetime.

SUMMARY OF THE INVENTION

It is an aspect of the present invention to solve the problems incurred in the related art, and to provide a plasma display panel device, a white linearity control device and a control method thereof, which are capable of suppressing variation of white linearity caused by uniformity of the PDP.

In accordance with one aspect, the present invention provides a white linearity control method of a plasma display panel including a plurality of address electrodes, a plurality of scan electrodes and a plurality of sustain electrodes. In this method, a load ratio of an image signal is calculated. An automatic power control level corresponding to the load ratio is determined, and first correction data corresponding to the automatic power control level is calculated. Vertical and horizontal positions of the image signal are discriminated. A white linearity value for a corresponding region is obtained from two white linearity values defining a period in which the discriminated positions are included through interpolation, and second correction data are produced by multiplying the first correction data by the obtained white linearity value.

In accordance with another aspect, the present invention provides a white linearity control device of a plasma display panel including a plurality of address electrode, a plurality of scan electrodes, and a plurality of sustain electrodes, comprising a gamma corrector, an automatic power controller, a position discriminator, a white linearity corrector, a sub-field data generator. The gamma corrector gamma-corrects an externally input image signal according to an automatic power control level to output first correction data. The automatic power controller calculates a load ratio of the first correction data to obtain the automatic power control level which is fed back to the gamma corrector, and outputs sustain and scan pulse information corresponding to the automatic power control level. The position discriminator discriminates and outputs vertical and horizontal positions of the image signal using vertical and horizontal synchronization signals included in the image signal. The white linearity corrector multiplies the first correction data by white linearity values corresponding to the vertical and horizontal positions discriminated in the position discriminator to generate second correction data. The sub-field data generator generates sub-field data using the second correction data.

In accordance with still another aspect, the present invention provides a plasma display panel device comprising a plasma display panel, a controller, an address electrode driver, and a sustain and scan electrode driver. The plasma display panel includes a plurality of address electrodes, a plurality of scan electrodes and a plurality of sustain electrodes, the plurality of scan electrodes and the plurality of sustain electrodes being arranged in pairs. The controller calculates a load ratio of an external image signal, produces and outputs sustain discharge pulse information corresponding to the calculated load ratio, determines vertical and horizontal positions of the image signal, multiplies white linearity values corresponding to the determined positions to produce correction data, and produces and outputs the correction data as sub-field data. The address electrode driver applies a voltage corresponding to the correction data outputted from the controller to the address electrodes of the plasma display panel. The sustain and scan electrode driver generates a sustain pulse and a scan pulse respectively corresponding to the sustain and discharge information from the controller and applies the generated sustain and scan pulses to the sustain and scan electrodes, respectively.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein:

FIG. 6 is a diagram illustrating an example of the white linearity.

DETAILED DESCRIPTION

Figure 1:
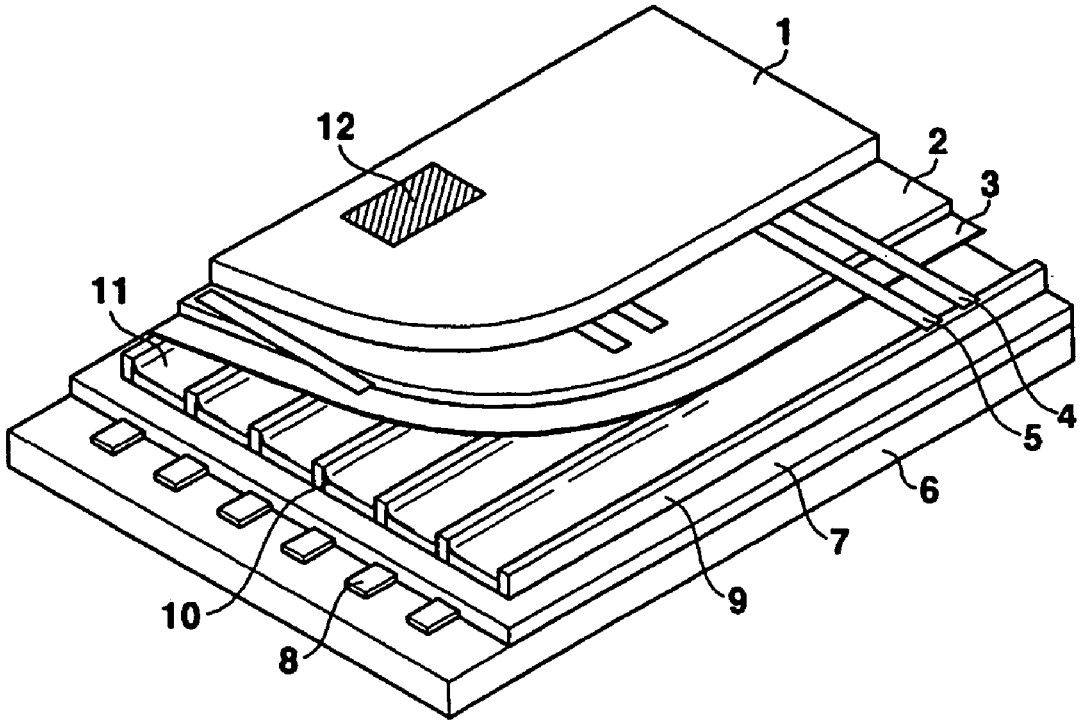
FIG. 1 is a perspective view illustrating a part of an AC PDP device.

FIG. 1 is a perspective view illustrating a part of an AC PDP.

Referring to FIG. 1, scan electrodes 4 and sustain electrodes 5 are arranged in pairs in parallel between a first substrate 1 and a dielectric layer 2 on a protective layer 3. A plurality of address electrodes 8, perpendicular to the scan and sustain electrodes 4 and 5, are arranged between a glass substrate 6 and an insulation layer 7. Barrier ribs 9 are formed in parallel with the address electrodes 8, between the protective layer 3 and the insulation layer 7, such that each barrier rib 9 is interposed between the adjacent address electrodes 8. A phosphor 10 is coated on the surface of the insulation layer 7 and on both sides of each partition wall 9.

Substrates 1 and 6 are arranged to face each other while defining a discharge space 11 therebetween. In the discharge space, a discharge cell 12 is formed at an intersection between each address electrode 8 and each pair of the scan electrodes 4 and sustain electrodes 5.

Figure 2:
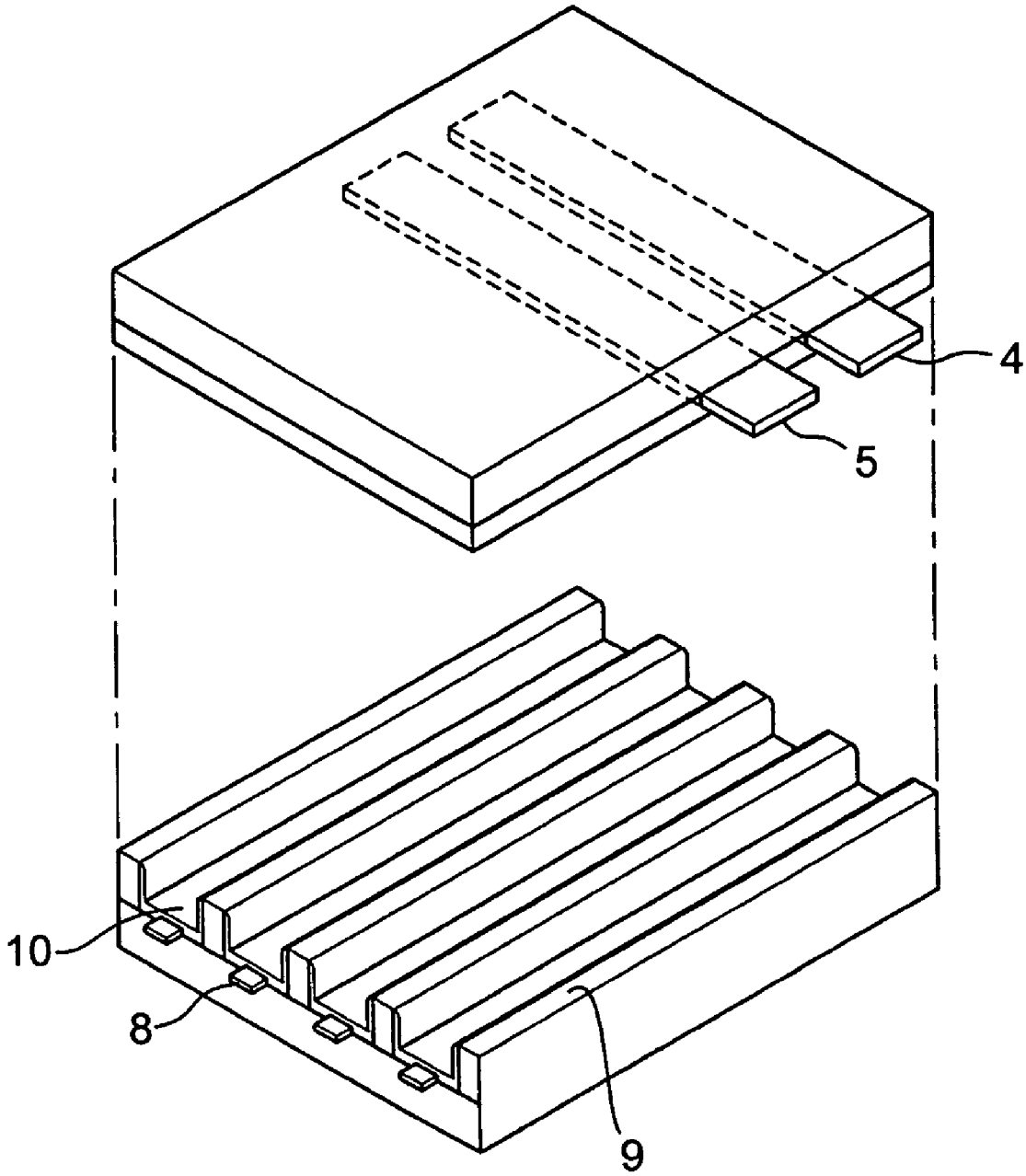
FIG. 2 is a diagram showing a structure of a three-electrode surface discharge of the PDP device of FIG. 1.

FIG. 2 shows a structure of a three-electrode surface discharge of the PDP.

Referring to FIG. 2, the address electrodes 8 orthogonally intersect with the scan electrodes 4 and sustain electrodes 5 arranged in parallel in the discharge cell formed by the barrier ribs 9. According to such a structure, a discharge is caused to generate wall charges for selection of a pixel between the address electrodes 8 and the scan electrodes 4. After this, a discharge is repeatedly caused between the scan electrodes 4 and the sustain electrodes 5 during a constant period of time so as to display a picture.

The barrier ribs 9 play a role in preventing cross talk between adjacent pixels by intercepting light generated when the discharge is caused, as well as forming the discharge space. A plurality of unit structures, which are defined by the barrier ribs 9, the scan electrodes 4, the sustain electrodes 5 and the address electrodes 8, are formed in the form of a matrix on one substrate. The plurality of unit structures is coated with phosphors 10 so as to form pixels composing one PDP. PDPs in current common use produce desired colors as ultraviolet rays caused by discharges, generated in the pixels, exciting the phosphors coated on the inner wall of the pixels.

In the mean time, an image signal inputted to the PDP is subject to gamma correction and error diffusion, that is, gamma values of digital picture data are corrected and display errors of the digital picture data are diffused with regard to adjacent pixels according to the properties of the PDP.

Nevertheless, a problem arises in that white linearity is not constant for each vertical and horizontal position of a screen due to uniformity of the PDP.

A more complete appreciation of the invention, and many of the attendant advantages thereof, will be readily apparent as the same becomes better understood by reference to the following detailed description when considered in conjunction with the accompanying drawings.

Figure 3:
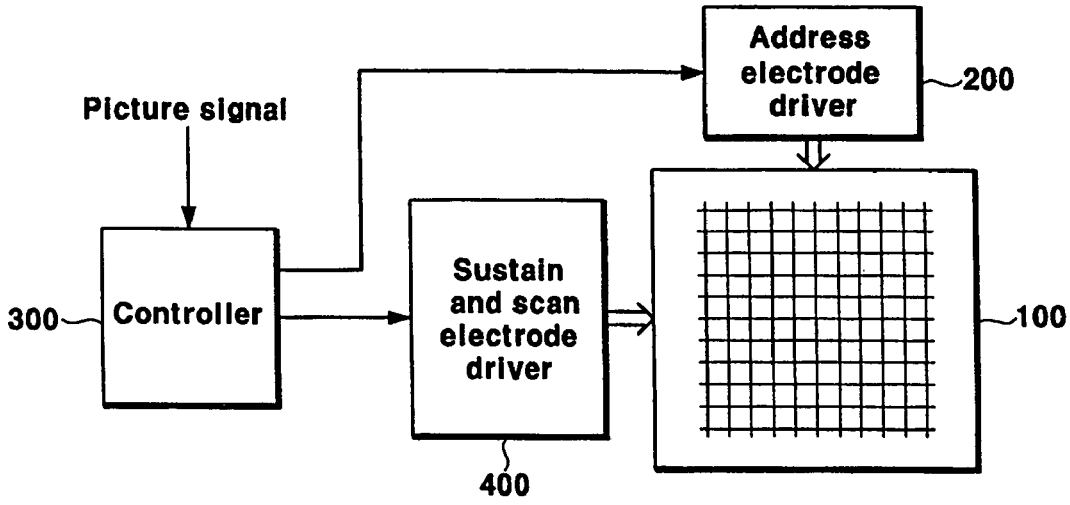
FIG. 3 is a diagram showing a configuration of a PDP device according to an embodiment of the present invention.

FIG. 3 is a diagram showing the configuration of a PDP device according to the embodiment of the present invention.

As shown in FIG. 3, the PDP device comprises a plasma display panel 100, an address electrode driver 200, a controller 300, and a sustain and scan electrode driver 400.

The plasma display panel 100 includes a plurality of address electrodes, and a plurality of scan electrodes paired with a plurality of sustain electrodes. The controller 300 calculates a load ratio of an external image signal, produces and outputs sustain discharge pulse information corresponding to the calculated load ratio, determines vertical and horizontal positions of the image signal, multiplies white linearity values corresponding to the determined positions to produce correction data, and produces and outputs the correction data as sub-field data.

The address electrode driver 200 applies a voltage corresponding to the sub-field data outputted from the controller 300 to the address electrodes of the plasma display panel. The sustain and scan electrode driver 400 generates a sustain pulse and a scan pulse, respectively, corresponding to the sustain and discharge information from the controller 300 and applies the generated sustain and scan pulses to the sustain and scan electrodes, respectively.

Figure 4:
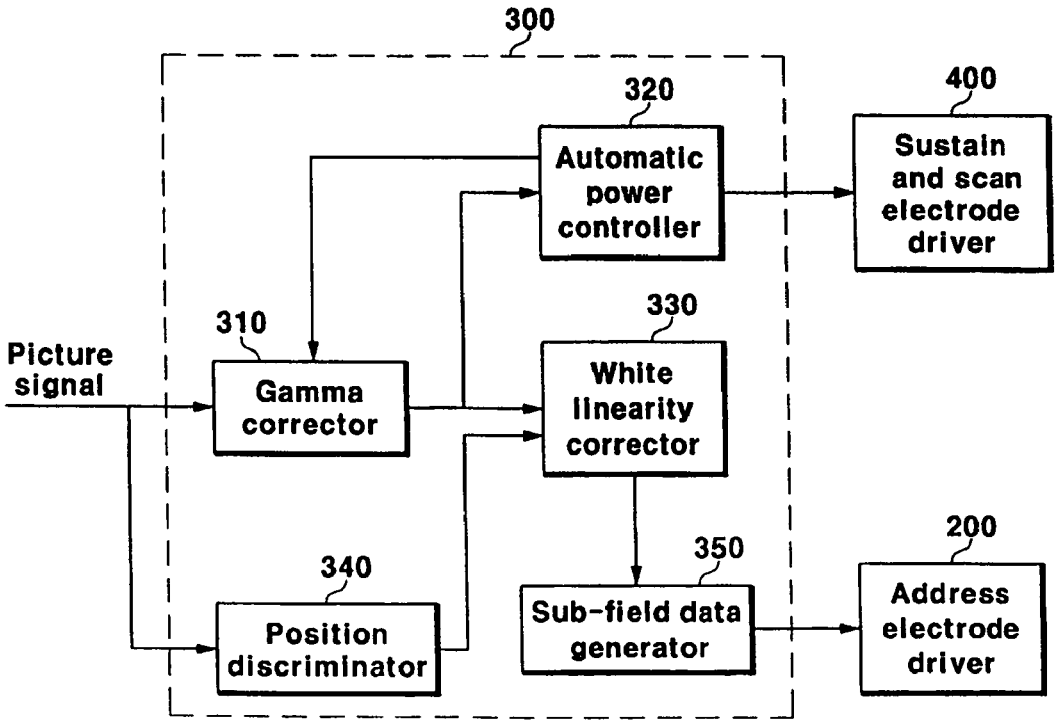
FIG. 4 is a diagram showing a configuration of a controller of FIG. 3.

FIG. 4 is a diagram showing the configuration of the controller 300 of FIG. 3.

Referring to FIG. 4, the controller 300 includes a gamma corrector 310 for gamma-correcting an externally input image (picture) signal according to an automatic power control level to output first correction data; an automatic power controller 320 for calculating the load ratio of the first correction data to obtain the automatic power control level which is fed back to the gamma corrector 310, and outputting sustain and scan pulse information corresponding to the automatic power control level; a position discriminator 340 for discriminating and outputting vertical and horizontal positions of the image signal using vertical and horizontal synchronization signals included in the image signal; a white linearity corrector 330 for multiplying the first correction data by white linearity values stored in Domain 0 to Domain N (correction tables of white linearity period sorter 331) corresponding to the vertical and horizontal positions discriminated in the position discriminator 340 to generate second correction data; and a sub-field data generator 350 for generating sub-field data using the second correction data.

Hereinafter, the plasma display panel 100, the white linearity corrector 330 and the control method thereof according to the present invention, as structured above, will be described.

First, when an image signal is externally inputted to the gamma corrector 310, the gamma corrector 310 gamma-corrects the image signal to output a gamma-corrected image signal, and the automatic power controller 320 calculates an average signal level, that is, a load ratio, of the image signal.

Then, the automatic power controller 320 determines an automatic power control level corresponding to the load ratio and generates sustain discharge pulse information and the number of sub-fields, which are outputted to the sustain and scan electrode driver 400. In addition, the automatic power controller 320 outputs the automatic power control level to the gamma corrector 310.

On the other hand, the position discriminator 340 discriminates the position of the currently inputted image signal based on horizontal and vertical synchronization signals inputted thereto and outputs the discriminated position to the white linearity corrector 330.

The white linearity corrector 330 corrects the white linearity such that correction data outputted from the gamma corrector 310 corresponds to the position of the image signal. At this time, the white linearity corrector 330 can perform a display error diffusion process on the correction data for surrounding pixels.

The sub-field data generator 350 generates the correction data as sub-field data.

The address electrode driver 200 generates an address voltage corresponding to the sub-field data outputted from the sub-field data generator 350 and applies the generated address voltage to address electrodes of the plasma display panel 100.

In addition, the sustain and scan electrode driver 400 generates sustain and scan voltages corresponding to the sustain discharge pulse information outputted from the automatic power controller 320 and applies the generated sustain and scan voltages to the sustain and scan electrodes of the plasma display panel, respectively.

Through the above-described process, relevant picture data is displayed on the plasma display panel 100.

Operation of the gamma corrector 310 and the white linearity corrector 330 in the process will now be described in detail.

Figure 5:
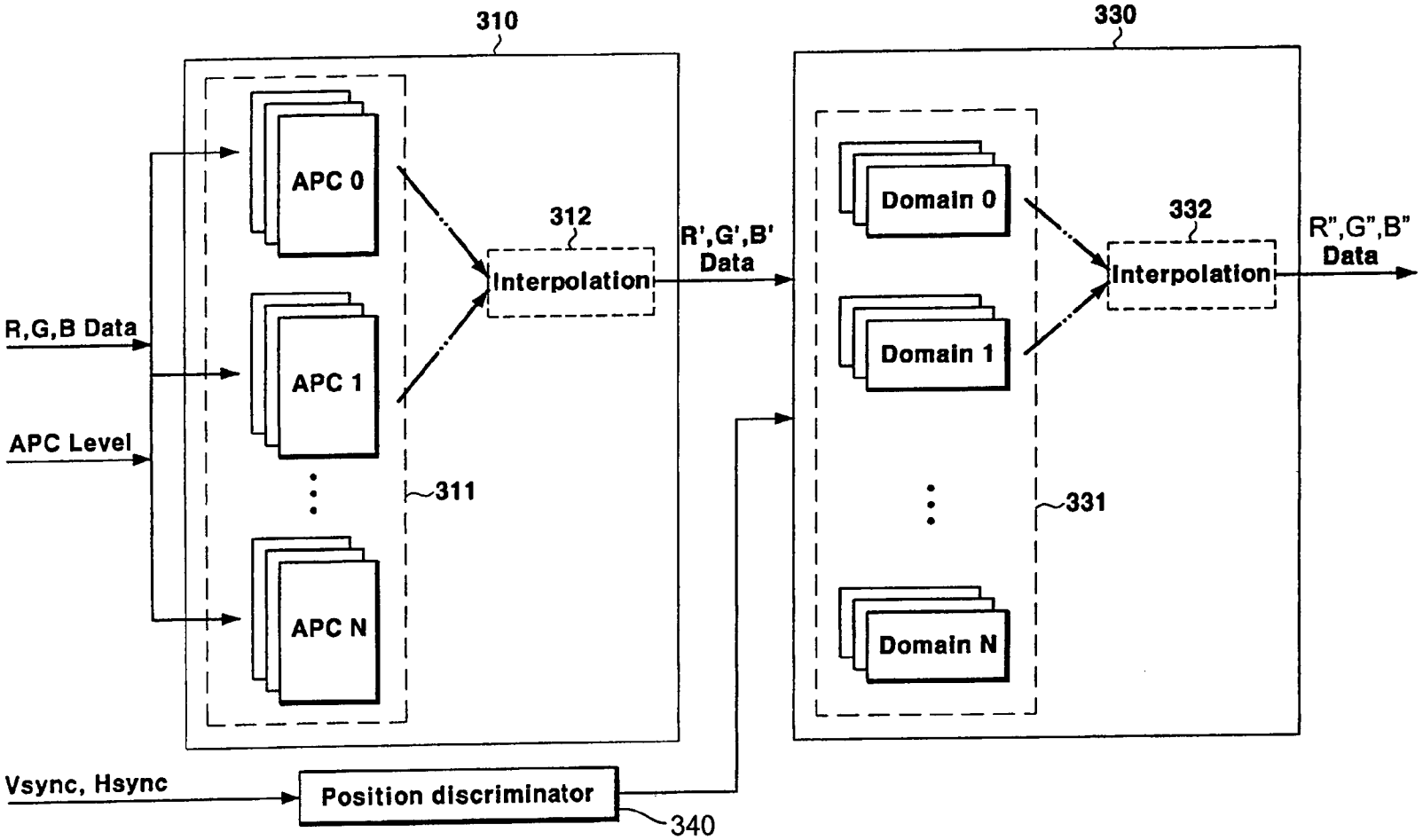
FIG. 5 is a detailed diagram of a gamma corrector and a white linearity corrector of FIG. 4.

Referring to FIG. 5, the automatic power control level is feedback from the automatic power controller 320 to the gamma corrector 310. An automatic power control (APC) period sorter 311 determines a period to which an input APC level belongs, and selects two correction tables included in this period. At this time, the APC level is divided into N-1 periods divided by the number, N, of gamma correction tables. Each of N gamma correction tables dividing the entire APC level period into N-1 levels is a correction data table of a corresponding APC level.

A gamma interpolation operator 312 calculates correction data for any APC level belonging to a period from two correction tables defining one period through interpolation.

On the other hand, the position discriminator 340 discriminates vertical and horizontal positions of the image signal by counting input data based on vertical and horizontal synchronization signals Vsync and Hsync and outputs the discriminated positions to the white linearity corrector 330.

The white linearity corrector 330 includes a white linearity period sorter 331 for determining a period to which inputted vertical and horizontal positions belong, and selecting two correction tables (Domain 0, Domain 1, ~Domain N) included in this period; and a gamma interpolation operator 332 for calculating white linearity for any position belonging to a period from the two correction tables through interpolation, and calculating second correction data by multiplying the first correction data by values of a first color, a second color, and a third color of the white linearity.

For example, five gamma correction tables

APC000: Table 0
APC064: Table 1
APC128: Table 2
APC192: Table 3
APC255: Table 4 may be used when the APC has a total of 255 steps. If a current input is APC255 and full white, R'G'B' data of gamma table 4 is outputted.

A region of the screen is divided as shown in FIG. 6. Then, the R'G'B' data is inputted to the white linearity corrector 330 and multiplied by respective white linearity (R00, G00, B00~R22, G22, B22) values to output R"G"B" data.

Here, each white linearity (R00, G00, B00~R22, G22, B22) value is a stored optimal value obtained through experimentation.

In addition, if a white linearity value is a value in the gamma correction table, the R"G"B" data is outputted through the interpolation operation of the white linearity value.

Here, the interpolation operation is an operation to use correction data in the APC064 table and the APC000 table in order to calculate correction data in an APC032 table. That is, a value of correction in the APC032 table is half a value of correction data in the APC064 table as this table is a middle table between the APC064 table and the APC000 table. If the APC032 table is not the middle table, the value of correction in the APC032 table can be obtained by multiplying this value by an appropriate factor. Such a linear interpolation operation is well known in the art.

By using the linear interpolation operation, the correction data corresponding to automatic power control steps in all periods can be generated even by small memory capacity, and, when the need arises, results of experiments on the automatic power control steps in all periods and the white linearity periods without using the linear interpolation operation.

As described above, according to the embodiment of the present invention, the white linearity can be constantly maintained by outputting different correction data values depending on the vertical and horizontal positions of the input picture data.

There are various modifications of such a white linearity correction.

As is apparent from the above description, by generating the correction data corresponding to the vertical and horizontal positions of the image signal, the problem that the white linearity for each vertical and horizontal position of the screen is not constant due to the uniformity of the plasma display panel can be overcome, that is, the white linearity can be maintained constant.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A white linearity control device of a plasma display panel including a plurality of address electrodes, a plurality of scan electrodes, and a plurality of sustain electrodes, comprising:

a gamma corrector for gamma-correcting an externally input image signal according to an automatic power control (APC) level to output first correction data;

an automatic power controller for calculating a load ratio of the first correction data to obtain the automatic power control level which is fed back to the gamma corrector, and outputting sustain and scan pulse information corresponding to the automatic power control level;

a position discriminator for receiving the externally input image signal and for discriminating and outputting vertical and horizontal positions of the input image signal using vertical and horizontal synchronization signals included in the input image signal;

a white linearity corrector for receiving the first correction data from the gamma corrector and receiving the discriminated vertical and horizontal positions from the position discriminator, and for multiplying the first correction data by white linearity values corresponding to the vertical and horizontal positions discriminated in the position discriminator to generate second correction data; and a sub-field data generator for generating sub-field data using the second correction data.

2. The white linearity control device of claim 1, wherein the gamma corrector includes:

an APC period sorter for determining a period to which an input APC level belongs, and selecting two correction tables included in this period; and a gamma interpolation operator for calculating the first correction data for any APC level belonging to a period from the two correction tables through interpolation.

3. The white linearity control device of claim 2, wherein the APC level is divided into N-1 periods divided by the number, N, of gamma correction tables contained in the gamma corrector.

4. The white linearity control device of claim 1, wherein the white linearity corrector includes:

a white linearity period sorter for determining a period to which inputted vertical and horizontal positions belong, and selecting two correction tables included in this period; and a gamma interpolation operator for calculating white linearity for any position belonging to a period from the two correction tables through interpolation, and calculating second correction data by multiplying the first correction data by values of a first color, a second color, and a third color of the white linearity.

5. A plasma display panel device comprising:

a plasma display panel including a plurality of address electrodes, a plurality of scan electrodes and a plurality of sustain electrodes, the plurality of scan electrodes and the plurality of sustain electrodes arranged in pairs;

a controller comprising a gamma corrector for gamma-correcting an externally input image signal according to an automatic power control (APC) level to output first correction data, an automatic power controller for calculating a load ratio of the first correction data to obtain the automatic power control level which is fed back to the gamma corrector, and outputting sustain and scan pulse information corresponding to the automatic power control level, a position discriminator for receiving the externally input image signal and for discriminating and outputting vertical and horizontal positions of the input image signal using vertical and horizontal synchronization signals included in the input image signal, a white linearity corrector for receiving the first correction data from the gamma corrector and receiving the discriminated vertical and horizontal positions from the position discriminator, and for multiplying the first correction data by white linearity values corresponding to the vertical and horizontal positions discriminated in the position discriminator to generate second correction data, and a sub-field data generator for generating sub-field data using the second correction data;

an address electrode driver for applying a voltage corresponding to the second correction data outputted from the controller to the address electrodes of the plasma display panel; and a sustain and scan electrode driver for generating a sustain pulse and a scan pulse respectively corresponding to the sustain and discharge information from the controller and applying the generated sustain and scan pulses to the sustain and scan electrodes, respectively.

6. The plasma display panel device of claim 5, wherein the gamma corrector includes:

an APC period sorter for determining a period to which an input APC level belongs, and selecting two correction tables included in this period; and a gamma interpolation operator for calculating the first correction data for any APC level belonging to a period from the two correction tables through interpolating operation.

7. The plasma display panel device of claim 6, wherein the APC level is divided into N-1 periods divided by the number, N, of gamma correction tables contained in the gamma corrector.

8. The plasma display panel of claim 5, wherein the white linearity corrector includes:

a white linearity period sorter for determining a period to which inputted vertical and horizontal positions belong, and selecting two correction tables included in this period; and a gamma interpolation operator for calculating white linearity for any position belonging to a period from the two correction tables through interpolation, and calculating second correction data by multiplying the first correction data by values of a first color, a second color, and a third color of the white linearity.

* * * * *